US006821151B2

(12) United States Patent
Lai

(10) Patent No.: US 6,821,151 B2
(45) Date of Patent: Nov. 23, 2004

(54) CABLE END CONNECTOR ASSEMBLY

(75) Inventor: Chin-Te Lai, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/392,605

(22) Filed: Mar. 19, 2003

(65) Prior Publication Data

US 2004/0147166 A1 Jul. 29, 2004

(30) Foreign Application Priority Data

Jan. 29, 2003 (TW) ..... 92201632

(51) Int. Cl.[7] ..... H01R 9/03
(52) U.S. Cl. ..... 439/610
(58) Field of Search ..... 439/610, 607, 439/608, 609, 101, 108

(56) References Cited

U.S. PATENT DOCUMENTS 5,518,421 A * 5/1996 Davis ..... 439/607
5,938,476 A * 8/1999 Wu et al. ..... 439/610
6,086,421 A * 7/2000 Wu et al. ..... 439/607
6,156,016 A * 12/2000 Maginot ..... 604/264
6,165,016 A 12/2000 Lai
6,210,230 B1 * 4/2001 Lai ..... 439/610
6,299,487 B1 10/2001 Lopata et al.

* cited by examiner

*Primary Examiner*—Hien Vu
(74) *Attorney, Agent, or Firm*—Wei Te Chung

(57) ABSTRACT

A cable end connector assembly (1) includes a cable end connector (10) and a cable (6). The cable end connector has an insulative housing (2), a number of contacts (31) received in the housing, and an integral shell (4) removably attached to the housing. The cable has a number of wires (63) respectively connecting to the contacts of the cable end connector and a shielding braid (62) enclosing the wires. The shell includes a first shielding portion (41) assembled to the housing, a second shielding portion (47) enclosing a section of the shielding braid, and a connecting portion (46) connecting the first and second shielding portions.

9 Claims, 8 Drawing Sheets

CABLE END CONNECTOR ASSEMBLY

CROSS-REFERENCE TO RELATED APPLICATION

This patent application is related to a contemporaneously filed application, having the same applicant, the same assignee and the same title with this patent application.

BACKGROUND OF THE INVENTION

1. Field of the Invention

The present invention relates to a cable end connector assembly, and more particularly to a cable end connector assembly having shielding means to prevent electromagnetic or radio frequency interference.

2. Description of Prior Art

Electrical connector assemblies are commonly used to connect external and internal peripheral devices to a computer for performing data transmission therebetween. These connector assemblies typically each employ a cable end connector assembly terminated with a transmission cable and a receptacle connector mounted on a printed circuit board of the computer and electrically connected with the cable end connector assembly. U.S. Pat. No. 6,299,487 (the '487 patent) discloses a connector assembly with a cable end connector assembly and a receptacle connector. The cable end connector assembly includes a housing, a contact module disposed in the housing with a plurality of contacts retained therein, a shell partially received in the housing for eliminating electromagnetic interference of the contacts, and a cable with a distal end thereof electrically connecting to the contacts.

As is shown in FIGS. 9 and 10 of the '487 patent, each grounding contact has a tail portion 133 longer and larger than tail portions 133 of the other contacts for receiving a grounding shield 135 attached to the cable 137 thereby eliminating electromagnetic interference of the cable.

However, since the grounding contacts have configuration different from the other contacts, the manufacturing and assembling process of the cable end connector assembly is complicated comparing with connectors with the contacts having the same configuration, and the cost and time of manufacture and assemble increase.

U.S. Pat. No. 6,165,016 (the '016 patent) discloses another cable end connector assembly 5. The assembly 5 includes a housing 6, a plurality of contacts 7 with the generally same configuration received in the housing 6, a first and a second shell 81, 82, and a cable 9 electrically connecting to the contacts 7. As is shown in FIGS. 3 and 4 of the '016 patent, the second shell 82 defines a front portion enclosing the housing and the contacts for eliminating electromagnetic interference of the contacts, a middle portion engaging with the first shell to enclosing the connection between the contacts and the cable for eliminating electromagnetic interference of the cable, and an elongated plate crimping to a jacket of the cable for strain relief. By this configuration, the contacts and the cable are both shielded. The assembly 5 needs two separate shells for shielding, thereby complicating the manufacturing and assembling process thereof and increasing the manufacture cost thereof.

Hence, a cable end connector assembly with effective shielding means and simple configuration is required to overcome the disadvantages of the prior art.

SUMMARY OF THE INVENTION

A major object of the present invention is to provide a structurally simplified cable end connector assembly having an effective shielding means.

In order to achieve the objects set forth, a cable end connector assembly includes a cable end connector and a cable. The cable end connector has an insulative housing, a plurality of contacts received in the housing, and an integral shell removably attached to the housing. The cable has a plurality of wires respectively connecting to the contacts of the cable end connector and a shielding braid enclosing said wires. The shell includes a first shielding portion assembled to the housing, a second shielding portion partially enclosing the shielding braid, and a connecting portion connecting the first and second shielding portions.

Other objects, advantages and novel features of the invention will become more apparent from the following detailed description when taken in conjunction with the accompanying drawings.

DETAILED DESCRIPTION OF THE INVENTION

Figure 1:
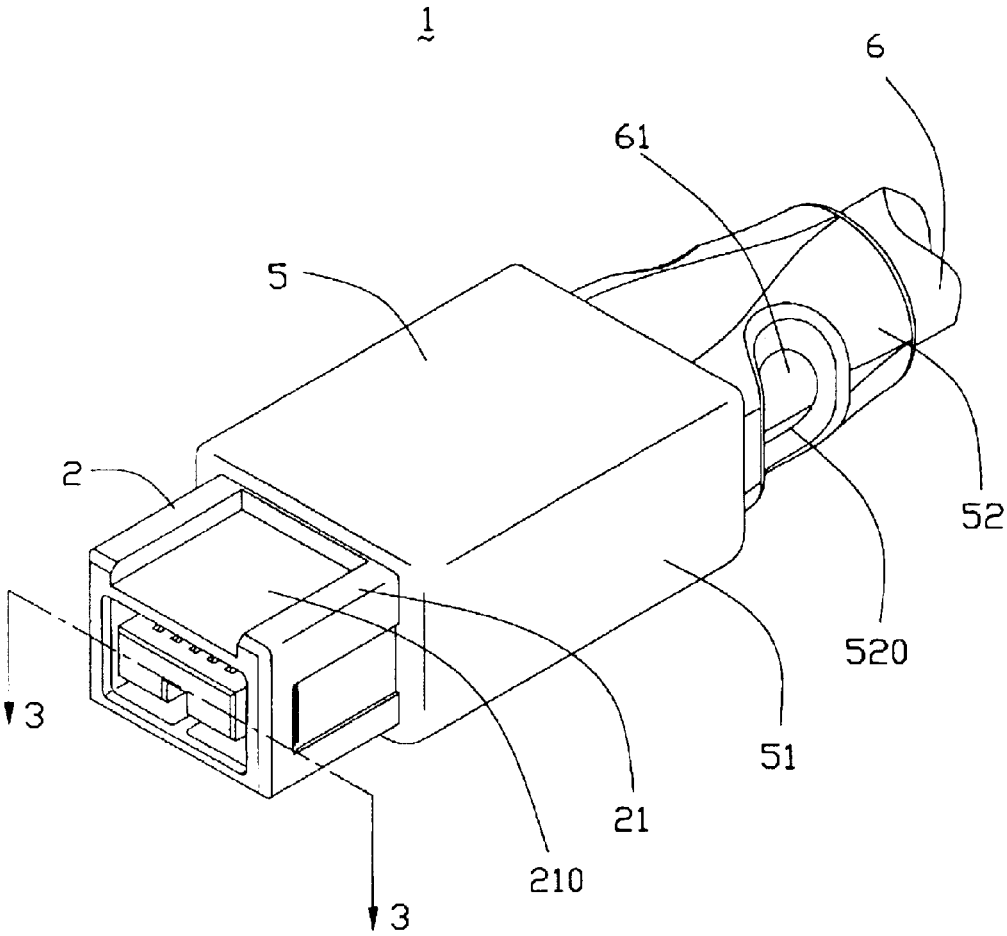
FIG. 1 is a perspective view of a cable end connector assembly in accordance with the present invention.
Figure 2:
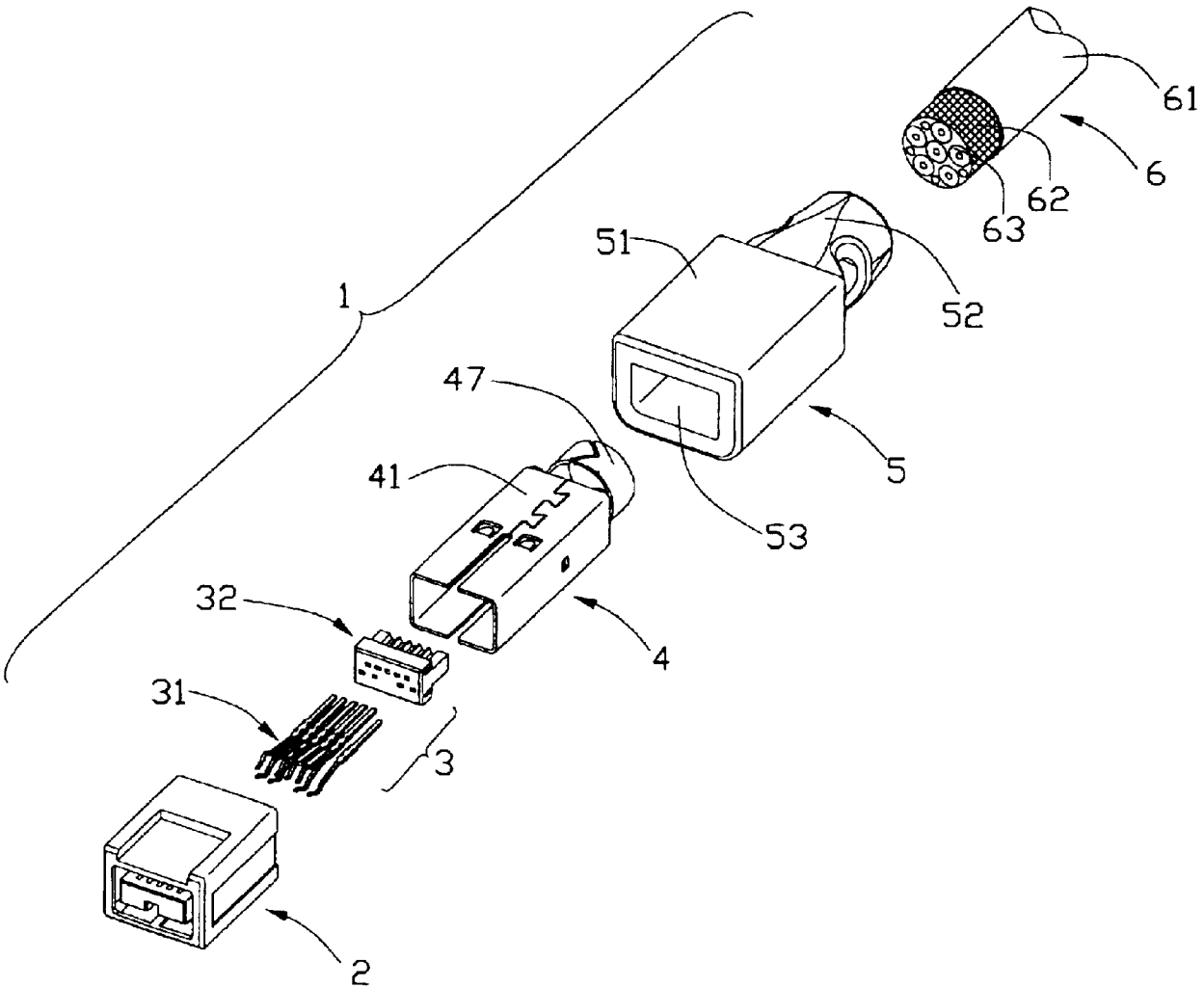
FIG. 2 is an exploded, perspective view of the cable end connector assembly of FIG. 1.
Figure 4:
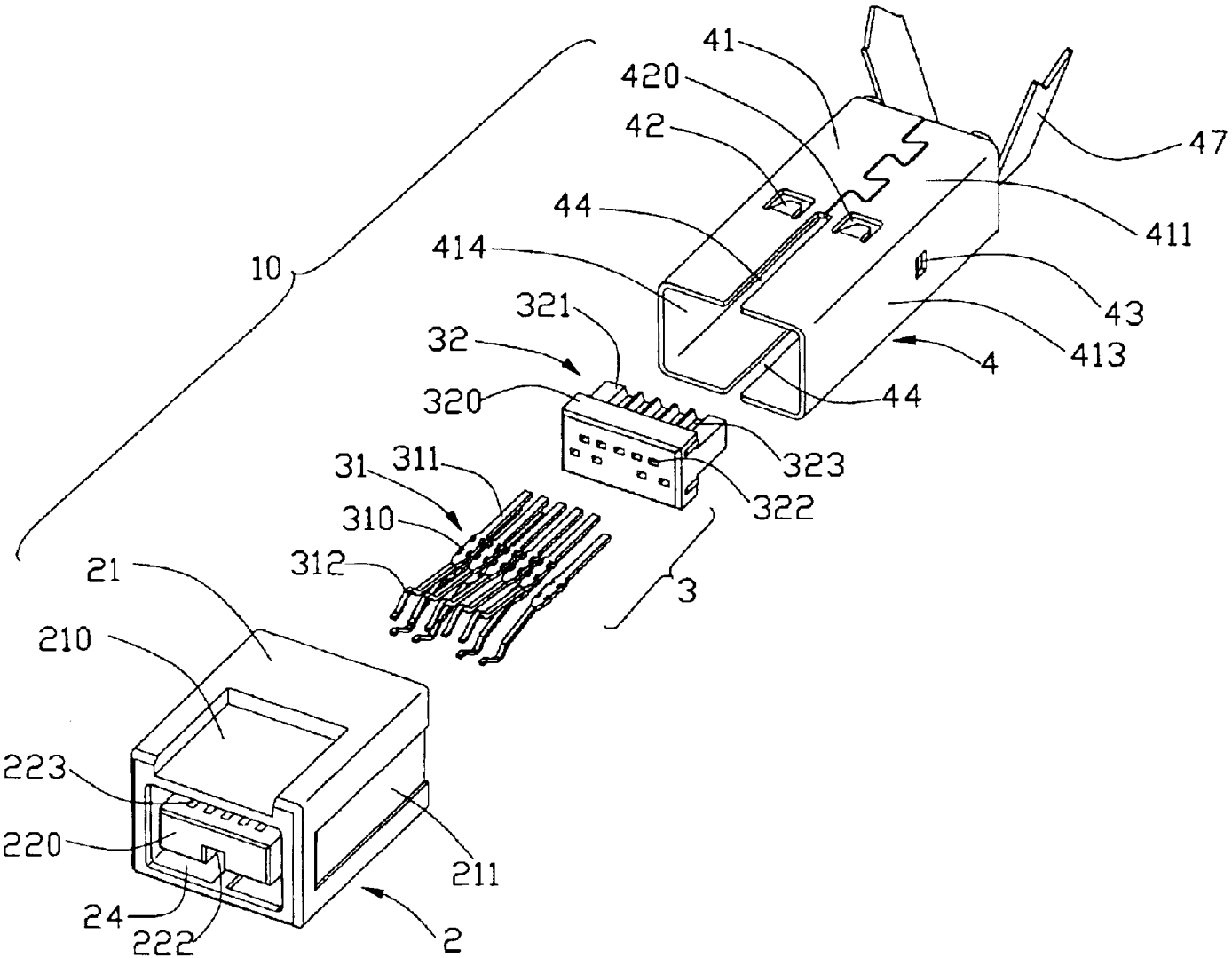
FIG. 4 is an exploded, perspective view of a cable end connector of the assembly in FIG. 1.
Figure 5:
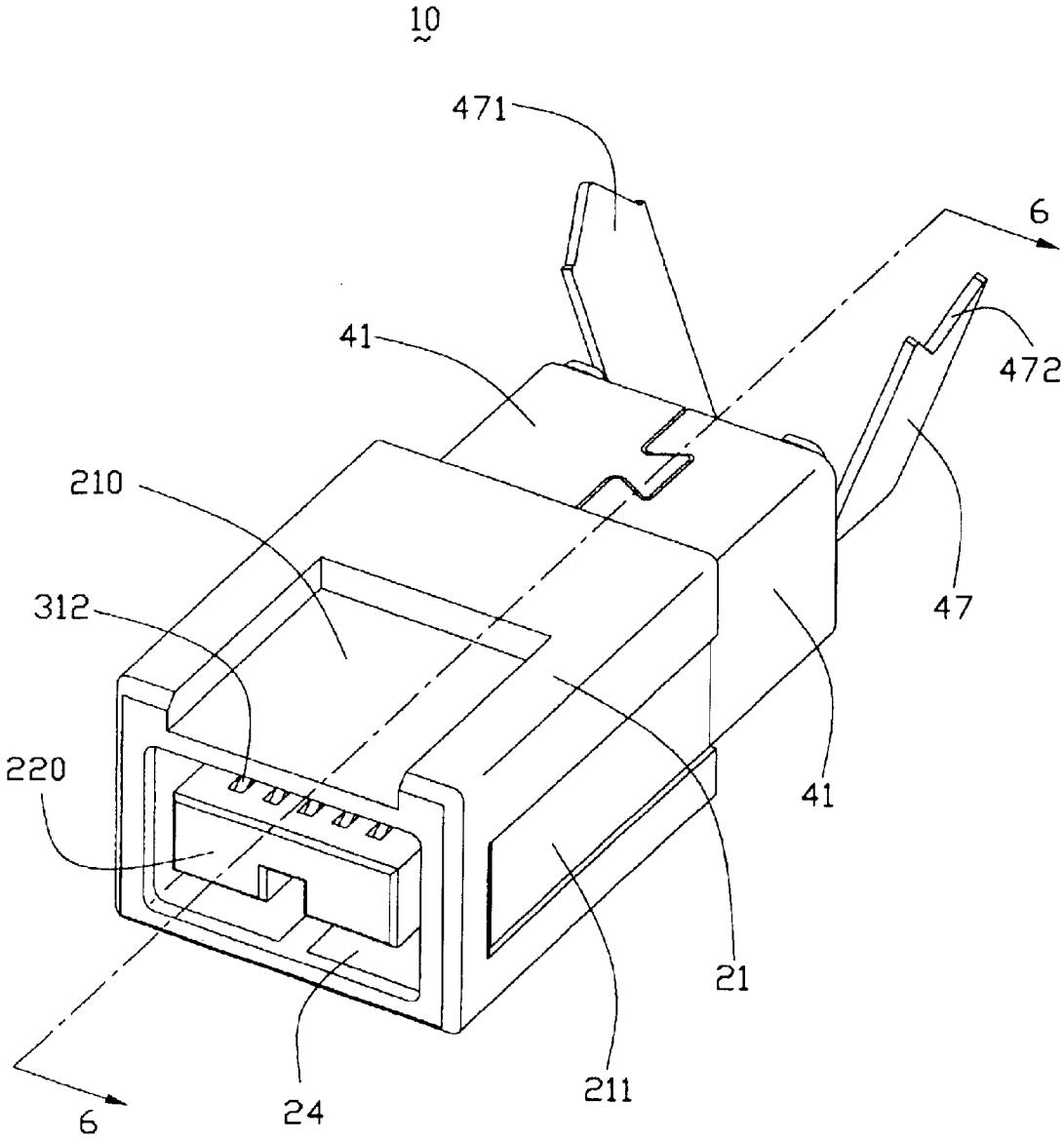
FIG. 5 is an assembled, perspective view of the cable end connector of FIG. 4.

Referring to FIGS. 1, 2 and 4, a cable end connector assembly 1 in accordance with the present invention comprises a cable end connector 10, an insulative cover 5, and a cable 6. The cable end connector 10 includes an insulative housing 2, a contact module 3, and an integral metallic shell 4.

In conjunction with FIGS. 5 to 9, the housing 2 includes a rectangular casing 21, a base 22 accommodated in the rectangular casing 21 and a tongue plate 220 extending forwardly from base 22 in the rectangular casing 21. The rectangular casing 21 defines a depression 210 in a top surface thereof and two recesses 211 in opposite side surfaces thereof. The rectangular base 22 and the rectangular casing 21 define a receiving slit 23 therebetween. The tongue plate 220 and the rectangular casing 21 define a receiving space 24 therebetween communicating with the receiving slit 23. Two elongated ribs 225 are formed between the rectangular base 22 and the rectangular casing 21 for connecting the rectangular base 22 and the rectangular casing 21 together. The rectangular base 22 defines a pair of elongated grooves 226 in an upper surface thereof with one of the ribs 225 located between the grooves 226, and a receiving concave 224 in a rear surface thereof.

The tongue plate 220 defines a plurality of passageways 223 in opposite upper and lower surfaces thereof. The passageways 223 communicate with the concave 224 and the receiving space 24. The tongue plate 220 defines an elongated recess 222 in the middle of the lower surface thereof for engagably receiving a corresponding portion of a complementary receptacle connector (not shown).

Also referring to FIG. 4, the contact module 3 includes a contact holder 32 and a plurality of contacts 31 assembled to the contact holder 32. The contact holder 32 is generally T-shaped in the cross-section thereof and includes a main portion 320 and a retention portion 321 extending rearwardly from a rear surface of the main portion 320. The main portion 320 defines a plurality of slots 322 extending along a front-to-rear direction. The retention portion 321 defines a plurality of apertures 323 in upper and lower surfaces thereof corresponding to the slots 322. All of the contacts 31 have the same configuration, and each contact 31 includes a contacting portion 312, a retaining portion 310 extending rearwardly from a rear end of the contacting portion 312, and a tail portion 311 extending rearwardly from a rear end of the retaining portion 310.

The shell 4 is stamped from a metallic sheet and includes a first shielding portion 41, a second shielding portion 47, and a connecting portion 46 between the first and second shielding portions 41, 47 for connecting the first and second shielding portions 41, 47 together. The first shielding portion 41 has an upper wall 411, an opposite lower wall 412, and two side walls 413 connecting with the upper and lower walls 411, 412. The upper, lower and side walls 411, 412, 413 together define a receiving room 414 therebetween. The upper and lower walls 411, 412 each defines a slit 44 extending from a front end thereof to a middle portion thereof. A pair of spring tabs 42 extend obliquely and inwardly from the top wall 41 and thus defines a pair of openings 420 on the top wall 41. A pair of tabs 43 extend perpendicularly into the receiving room 414 from opposite side walls 413. The connecting portion 46 extends rearwardly from a rear end of the lower wall 412. The second shielding portion 47 extends rearwardly from a rear end of the connecting portion 46 and then extends transversely to form a pair of arm portions 470 respectively with a neb 471 and a dent 472 at distal ends thereof.

The cable 6 includes a plurality of wires 63, a metallic shielding braid, 62 enclosing the wires 63, and an insulative jacket 61 enclosing the shielding braid 62.

The insulative cover 5 is over-molded with the cable end connector 10 and the cable 6 and includes a cuboid front portion 51 and a generally cylindrical rear portion 52 extending rearwardly from the front portion 51. The front portion 51 defines a cavity 53 therein for receiving a rear portion of the connector 10 and a front end of the cable 6. The rear portion 52 defines a pair of holes 520 in opposite sides thereof.

Figure 6:
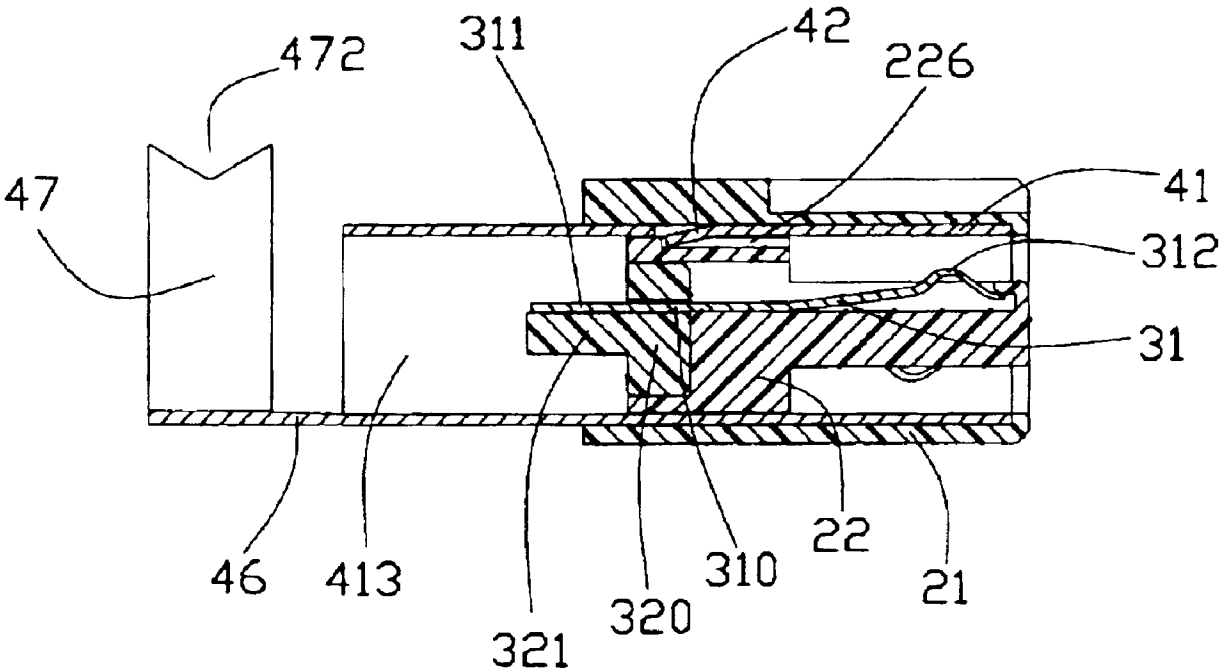
FIG. 6 is a cross-sectional view taken along line 6—6 of FIG. 5.
Figure 7:
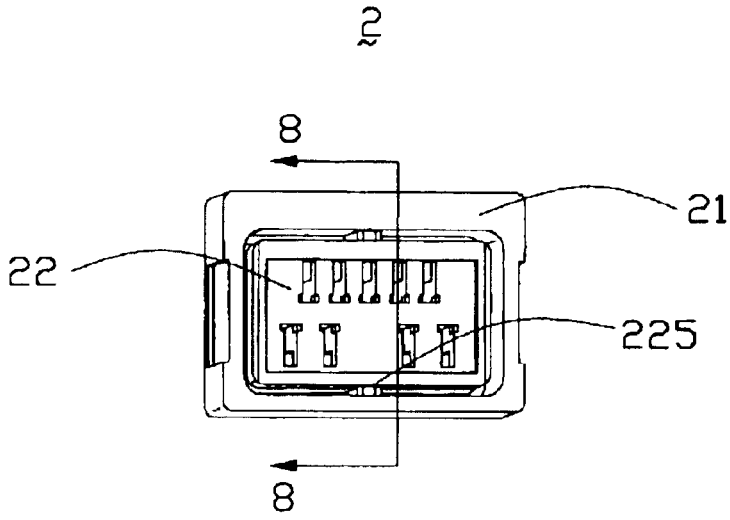
FIG. 7 is a rear view of a housing of the assembly of FIG. 1.
Figure 9:
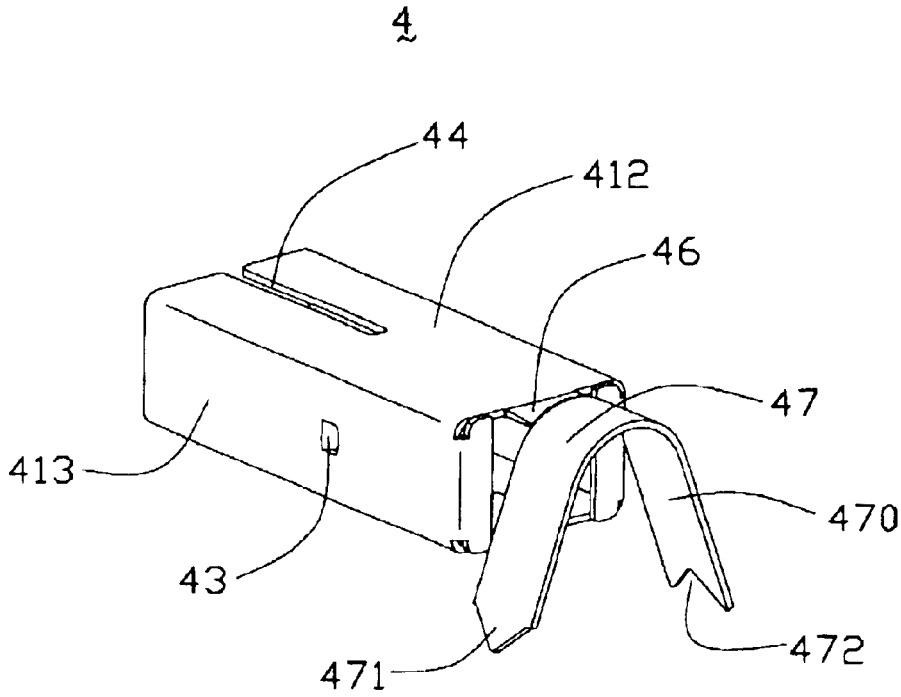
FIG. 9 is a perspective view of a shell of the assembly of FIG. 1.
Figure 8:
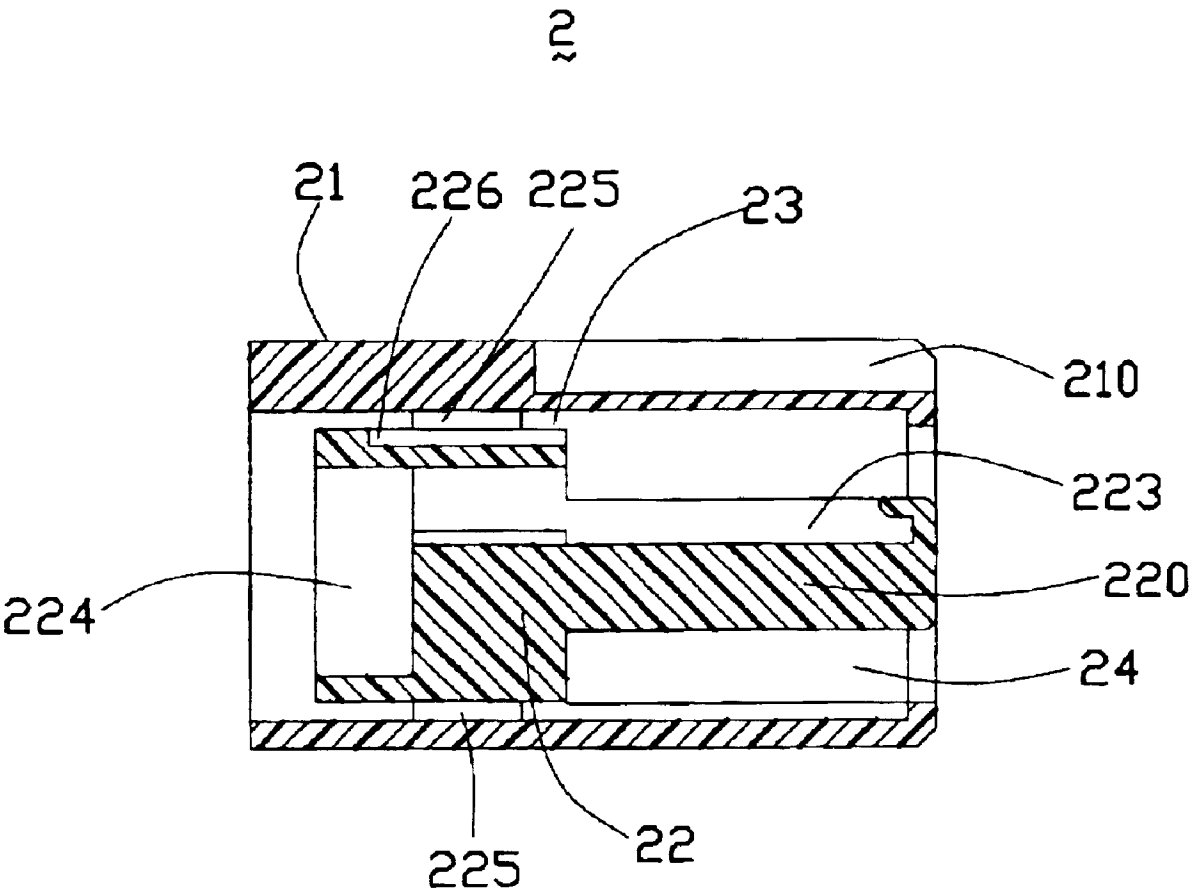
FIG. 8 is a cross-sectional view taken along line 8—8 of FIG. 7.

In assembly, the contacts 31 are inserted into the contact holder 32 to form the contact module 3 with the retaining portions 310 thereof retained in the corresponding slots 322 of the contact holder 32, the tail portion 311 extending in corresponding apertures 323 of the contact holder 32 and the contacting portion 312 extending forwardly beyond the main portion 320. The contact module 3 is assembled to the housing 2 along a rear-to-front direction. The main portion 320 of the contact holder 32 is received in the concave 224 of the base 22, and the contacting portion 312 of each contact 31 is received in a corresponding passageway 223 of the tongue plate 220 for electrically connecting to the complementary connector. The shell 4 is inserted into the housing 2 along a rear-to-front direction. As shown in FIG. 6, the first shielding portion 41 extends through the receiving slit 23 into the receiving space 24 to shield the contacts for eliminating electromagnetic interference. The two ribs 225 of the housing 2 are received in corresponding slits 44 of the shell 4 to guide the shell 4 into the housing 2.

The spring tabs 42 are received in corresponding grooves 226 defined in the upper surface of the base 22 with the free ends thereof abutting against the base 22 at rear ends of the grooves 226 to prevent the shell 4 moving rearwardly. The tabs 43 abut against a rear end face of the base 22 of the housing 2 to prevent the shell moving forwardly. By this way, the shell 4 can be assembled to the housing 2 readily and securely. If the shell 4 is to be separated from the housing 2, an external tool (not shown), such as a screwdriver, is inserted into the grooves 226 from a front end of the receiving space 24 to deform the spring tabs 42 upwardly and out of the grooves 226, thereby pulling the shell 4 backward. Therefore, the shell 4 is able to be removed from the housing 2 readily and be reworked and replaced individually.

Figure 3:
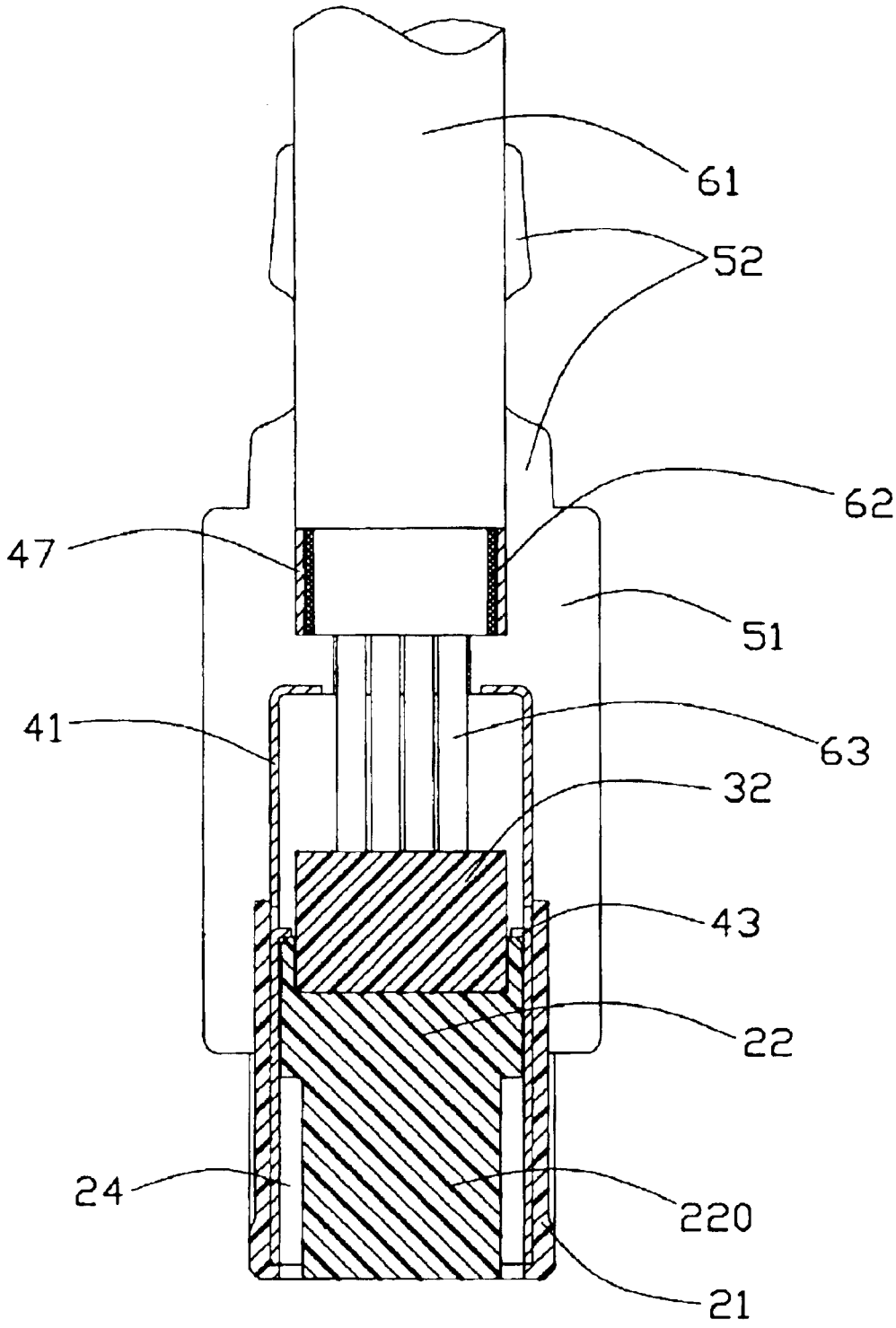
FIG. 3 is a cross-sectional view taken along line 3—3 of FIG. 1.

An end portion of the jacket 61 of the cable 6 is stripped off to expose the shielding braid 62 and a part of the exposed shielding braid 62 is stripped off to expose the wires 63. The wires 63 are soldered to the tail portions 311 of corresponding contacts 31. The two arm portions 470 of the second shielding portion 47 are crimped to form a circle with the neb 471 received in the dent 472 thereby defining a circular space for receiving the shielding braid 62 therein (as shown in FIG. 3). The insulative cover 5 is over-molded to the cable end connector 10 and the cable 6. The front portion 51 encloses the rear portion of the connector 10 and the front end portion of the cable 6, and the rear portion 52 encloses the insulative jacket 61 of the cable 6 to function as a strain relief.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. A cable end connector assembly comprising:

a cable end connector comprising an insulative housing, a plurality of contacts received in the insulative housing, and a conductive shell attached to the insulative housing, the shell comprising a first shielding portion assembled to the housing, a second shielding portion, and a connecting portion connecting the first and second shielding portions; and a cable comprising a plurality of wires respectively connecting to the contacts of the cable end connector and a shielding braid enclosing the wires and partially enclosed by the second shielding portion of the shell, wherein the second shielding portion comprises two arm portions extending transversely from the connecting portion and together defining a circular space for receiving the shielding braid of the cable, wherein the cable end connector comprises a contact holder for retaining the contacts, wherein the housing comprises a base for retaining the contact holder, a tongue plate extending from the base and a casing around the base and the tongue plate, wherein the base defines a concavity to receive the contact holder, and wherein the housing comprises a rib connecting the base and the casing together, and the shell having a slit for receiving the rib.

2. The cable end connector assembly as claimed in claim 1, wherein the cable comprises a jacket enclosing the shielding braid.

3. The cable end connector assembly as claimed in claim 1, wherein the two arm portions of the second shielding portion respectively comprises a neb and a dent, and wherein the neb is engageably received in the dent.

4. The cable end connector assembly as claimed in claim 1, wherein the shell comprises a tab extending inwardly to engage with the base to prevent the shell from moving forwardly.

5. The cable end connector assembly as claimed in claim 4, wherein the tab abuts against a rear end face of the base.

6. The cable end connector assembly as claimed in claim 1, wherein the shell comprises a spring tab extending inwardly to mate with the base to prevent the shell from moving rearwardly.

7. The cable end connector assembly as claimed in claim 6, wherein the base defines a groove receiving the spring tab, and wherein the spring tab abuts against the base at a rear end of the groove.

8. The cable end connector assembly as claimed in claim 1, further comprising an insulative cover over-molded to the cable end connector and the cable.

9. A cable end connector assembly comprising: an insulative housing comprising a receiving space, a base for retaining a contact holder, a tongue plate extending from the base, a casing around the base and the tongue, and a rib in between the base and the casing for connecting the base to the casing a back-to-front receiving slit defined in the housing with a groove thereabouts;

a plurality of terminals disposed in the housing with contact portions exposed on the tongue plate;

a conductive tubular shell defining a rectangular cross-section thereof, said shell defining at least one slit to receive the rib and corresponding portions of the housing to extend therethrough, said shell defining a locking tab, said shell forwardly inserted into the receiving slit from a rear face of the housing until the locking tab latchably engaged within the groove;

a cable including a plurality of wires electrically connected to the corresponding terminals; wherein said shell is dimensioned to extend far beyond the rear face of the housing and is equipped with a crimp portion gripping said cable;

wherein said cable includes exposed shielding braiding with said crimping portion gripping thereon.

* * * * *